US006545401B2

(12) United States Patent
Ha et al.

(10) Patent No.: US 6,545,401 B2
(45) Date of Patent: Apr. 8, 2003

(54) COLOR SELECTION APPARATUS FOR CATHODE RAY TUBE

(75) Inventors: Kuen-Dong Ha, Suwon (KR); Kwang-Sik Lee, Suwon (KR); Arimoto Nozomu, Suwon (KR); Duk-Hyun Choe, Suwon (KR); Hoo-Deuk Kim, Suwon (KR); Gui-Bae Kim, Suwon (KR); Woo-Il Park, Kyungki-do (KR)

(73) Assignee: Samsung SDI Co., Ltd., Suwon (KR)

( * ) Notice: Subject to any disclaimer, the term of this patent is extended or adjusted under 35 U.S.C. 154(b) by 35 days.

(21) Appl. No.: 09/940,809

(22) Filed: Aug. 29, 2001

(65) Prior Publication Data

US 2002/0079814 A1 Jun. 27, 2002

(30) Foreign Application Priority Data

Dec. 27, 2000 (KR) ..... 2000-83082

(51) Int. Cl.[7] ..... H01J 29/80
(52) U.S. Cl. ..... 313/402; 313/407
(58) Field of Search ..... 313/402, 407

(56) References Cited

U.S. PATENT DOCUMENTS 5,382,871 A 1/1995 Funahashi et al. ..... 313/402
5,801,479 A 9/1998 Shinoda ..... 313/402

FOREIGN PATENT DOCUMENTS

JP 62-249339 10/1987
JP 11-250824 9/1999

*Primary Examiner*—Vip Patel
(74) *Attorney, Agent, or Firm*—Staas & Halsey LLP

(57) ABSTRACT

A color selection apparatus for a cathode ray tube includes an iron mask having a longitudinal axis and a short axis and a frame coupled with the mask and tensing the mask in one direction of the longitudinal and short axes. The mask includes a plurality of strips spaced apart from one another at predetermined intervals and a plurality of electron beam through holes formed by a plurality of real bridges arranged between the respective strips at predetermined pitches, wherein a center point of the mask along the longitudinal axis is A, both end points of the mask along the longitudinal axis are B, a length of a longitudinal side of the mask is 2L, point greater than L/4 from the point A in each direction are C, a tension applied to the strip of the point A is smaller than a tension applied to the strips of the points B and a distribution curve of a tension applied to the strips of the mask along the longitudinal direction satisfies the following equation;

$$|S_{A-C}|<|S_{C-B}|$$

wherein $S_{A-C}$ represents a slope of a straight line that links the point A to one of the points C on the tension distribution curve and $S_{C-B}$ represents a slope of a straight line that links the one point C to the corresponding point B on the tension distribution curve.

20 Claims, 11 Drawing Sheets

COLOR SELECTION APPARATUS FOR CATHODE RAY TUBE

CROSS-REFERENCE TO RELATED APPLICATIONS

This application claims the benefit of Korean Application No. 2000-83082, filed Dec. 27, 2000, in the Korean Patent Office, the disclosure of which is incorporated herein by reference.

BACKGROUND OF THE INVENTION

1. Field of the Invention

The present invention relates to a cathode ray tube, and more particularly, to a color selection apparatus for a cathode ray tube in which a color image is displayed in the cathode ray tube.

2. Description of the Related Art

A cathode ray tube that is a main image display device is being developed in various types as a result of changing times. Recently, to display a natural and clear image on the whole screen, a flat panel cathode ray tube, in which an entire surface of a panel provided with a screen is formed in a flat panel, is receiving much attention.

Furthermore, because of the preferences of consumers who desire to view an image displayed in a cathode ray tube such as a color television and a monitor for a computer on a larger screen, it is a general tendency that the screen of the cathode ray tube, i.e., the panel provided with the screen, has a large size.

In view of a flat panel with a large size in a cathode ray tube, it is a given that a shadow mask adapted to display colors also has a large size. However, there are limitations, such as intensity and other factors, in forming a large sized shadow mask with a curved shape. In this respect, new shadow masks for a cathode ray tube have been developed.

One of them is disclosed in the Japanese Patent Publication No. 62-249339. In this Japanese Patent Publication, a shadow mask having a plurality of electron beam through holes is not curved but is formed in a flat panel, so that it is maintained at a predetermined tension. The shadow mask is based on an aperture grill-type in which an electrode frame having a plurality of grid members arranged at a predetermined pitch is formed by applying a tension thereon. In the shadow mask, it is noted that the distribution of the tension applied to the electrode frame along a longitudinal side of the electrode frame gradually increases from the center of the electrode frame to both end portions.

Another shadow mask for a cathode ray tube is disclosed in the U.S. Pat. No. 5,801,479. This shadow mask is also based on an aperture grill-type. The distribution of tension applied to the aperture grill gradually increases from the center of the aperture grill to both end portions along a longitudinal side of the aperture grill. The aperture grill-type shadow mask, as is known, has advantages in that it can improve doming or discoloration characteristics as compared with a typically formed mask with a curved shape. However, the shadow mask has a problem in that is likely to generate howling due to external sound or impact.

To solve the above problem, a shadow mask for a cathode ray tube has been suggested in which damper wires are mounted across an outer surface of the aperture grill to prevent howling from being generated, as disclosed in the U.S. Pat. No. 5,382,871. However, the shadow mask provided with the damper wires has a problem in that unnecessary lines occur on the screen of the cathode ray tube due to the damper wires, thereby deteriorating picture quality. This problem seriously arises when the cathode ray tube is adapted for a monitor for a computer.

Furthermore, in another related art, a color cathode ray tube is disclosed in the Japanese Patent Publication No. 11-250824. In this related art, the color cathode ray tube has a shadow mask of Invar material (36% Ni—Fe alloy) applied with a tension of 5~90% against a tension generated when electron beams do not move at all. Since the color cathode ray tube can effectively suppress howling generated in the shadow mask without damper wires, it is possible to prevent a visual problem resulting from the damper wires. However, since the shadow mask is formed of expensive Invar material, a problem arises in that the manufacturing cost is high.

As described above, the related art shadow masks for a flat panel cathode ray tube are configured to form one assembly body by differentiating the distribution of the tension applied to the shadow mask (or aperture grill). However, they do not give the best satisfaction to consumers or manufacturers for a flat panel cathode ray tube due to the aforementioned problems.

SUMMARY OF THE INVENTION

Accordingly, the present invention is directed to a color selection apparatus for a cathode ray tube that substantially obviates one or more of the problems due to limitations and disadvantages of the related art.

An object of the present invention is to provide a color selection apparatus for a cathode ray tube that can optimize satisfaction for use in view of visual, performance, and cost aspects.

Another object of the present invention is to provide a cathode ray tube having a color selection apparatus that can optimize satisfaction for use in view of visual, performance, and cost aspects.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a color selection apparatus for a cathode ray tube according to the present invention includes: an iron mask having a longitudinal axis and a short axis; and a frame coupled with the mask and tensing the mask in one direction of the longitudinal and short axes, the mask comprising a plurality of strips spaced apart from one another at predetermined intervals, and a plurality of electron beam through holes formed by a plurality of real bridges arranged between the respective strips at predetermined pitches, wherein a center point of the mask along the longitudinal axis is A, both end points of the mask along the longitudinal axis are B, a length of a longitudinal side of the mask is 2L, point greater than L/4 from the point A in each direction are C, a tension applied to the strip of the point A is smaller than a tension applied to the strips of the points B and a distribution curve of a tension applied to the strips of the mask along the longitudinal direction satisfies the following equation;

$$|S_{A-C}|<|S_{C-B}|$$

wherein $S_{A-C}$ represents a slope of a straight line that links the point A to one of the points C on the tension distribution curve, and $S_{C-B}$ represents a slope of a straight line that links the one point C to the corresponding point B on the tension distribution curve.

To further achieve these and other advantages and in accordance with the purpose of the present invention, as embodied and broadly described, a cathode ray tube according to the present invention includes: a panel provided with a fluorescent screen inside thereof; a funnel connected with the panel and provided with a deflection unit on a circumference thereof, the deflection unit deflecting electron beams; a neck portion connected with the funnel and provided with an electron gun to scan the electron beams to the fluorescent screen; and a color selection apparatus fixed inside the panel, selecting the electron beams to land on corresponding phosphors of the fluorescent screen, the color selection apparatus comprising an iron mask having a longitudinal axis and a short axis; and a frame coupled with the mask and tensing the mask in one direction of the longitudinal and short axes, the mask comprising a plurality strips spaced apart from one another at predetermined intervals; a plurality of electron beam through holes formed by a plurality of real bridges arranged between the respective strips at predetermined pitches, and at least one dummy bridge extended from the strips in one direction of the electron beam through holes and arranged within the electron beam through holes, wherein a center point of the mask along the longitudinal axis is A, both end points of the mask along the longitudinal axis are B, a length of a longitudinal side of the mask is 2L, points greater than L/4 from the point A in each direction are C, a tension applied to the strip of the point A is smaller than a tension applied to the strips of the point B and a distribution curve of a tension applied to the strips of the mask along the longitudinal direction satisfies the following equation;

$$|S_{A-C}|<|S_{C-B}|$$

wherein $S_{A-C}$ represents a slope of a straight line that links the point A to the point C on the tension distribution curve and $S_{C-B}$ represents a slope of a straight line that links the one point C to the corresponding point B on the tension distribution curve.

In the color selection apparatus for a cathode ray tube according to the present invention, the distribution of the tension applied to the strips of the mask having a substantially rectangular shape has almost the same tension value from the center of the mask to a certain portion toward both side ends and an increasing tension value from the certain portion to both side ends when viewing the tension distribution along the longitudinal axis of the mask. That is, when viewing the tension distribution on the whole mask, the tension distribution has a flat U shape.

The tension distribution can be efficiently used to attenuate serious howling generated in peripheries of the mask as compared with the center of the mask. That is, even if high howling occurs in the center of the mask due to a small amount of the tension applied to the center of the mask to increase attenuation time, the electron beams landing on the center of a screen through the center of the mask are minimally affected by howling of the mask as the direction of travel of the electron beams is substantially the same as the direction of vibration of the central portion of the shadow mark. Accordingly, picture quality can be improved.

The tension distribution of the present invention is configured so as to obtain the best conditions such as pattern and material characteristics of the electron beam through holes of the mask and to reduce howling and doming resulting from external factors when the mask is applied to the cathode ray tube.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

DETAILED DESCRIPTION OF THE PREFERRED EMBODIMENT

Figure 1:
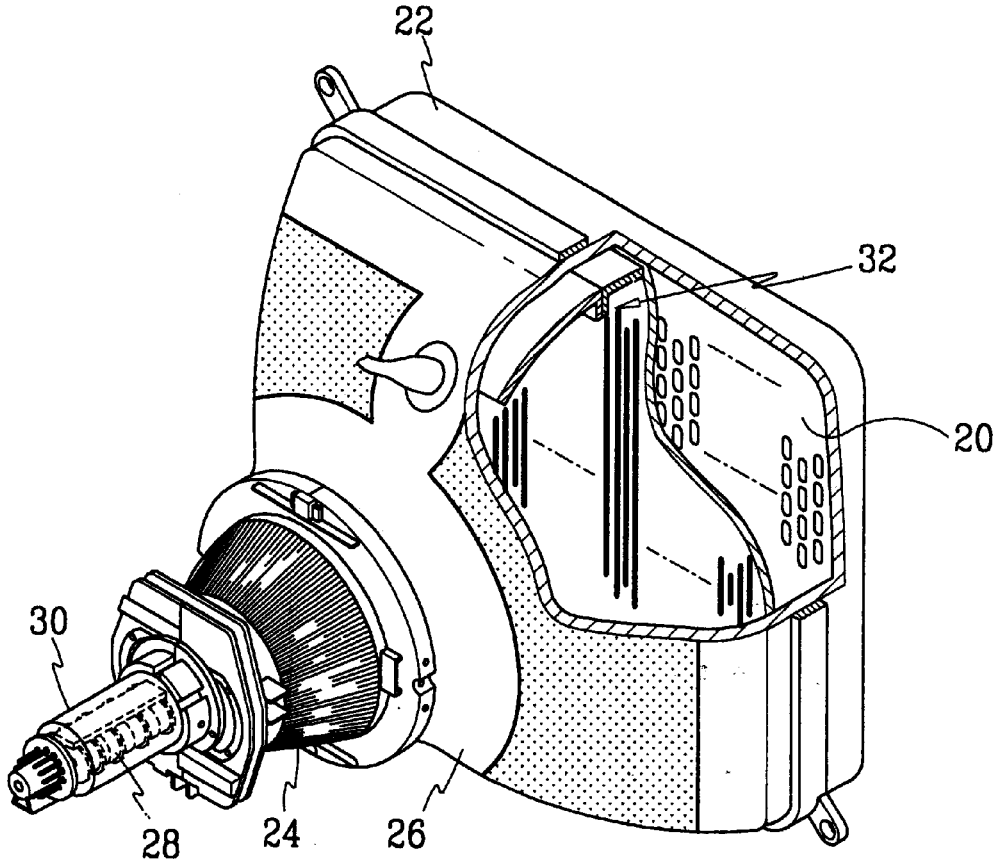
FIG. 1 is a partially exploded perspective view illustrating a cathode ray tube provided with a shadow mask according to an embodiment of the present invention.

Reference will now be made in detail to the preferred embodiments of the present invention, examples of which are illustrated in the accompanying drawings, wherein like reference numerals refer to like elements throughout.

Figure 2:
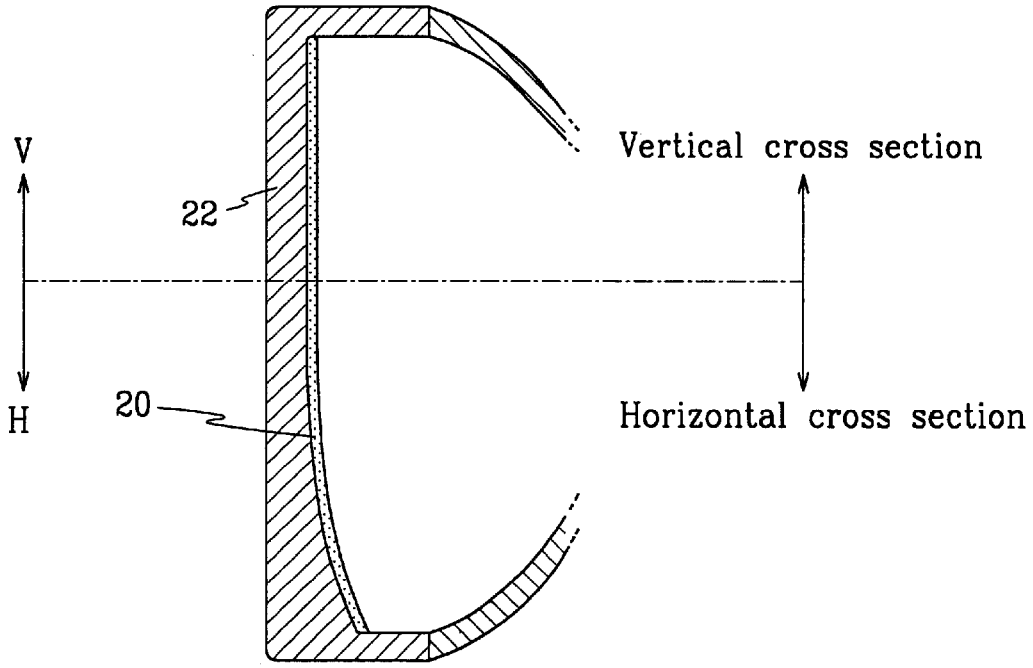
FIG. 2 is a partial sectional view of the cathode ray tube of FIG. 1.

FIG. 1 is a partially exploded perspective view illustrating a cathode ray tube provided with a shadow mask according to an embodiment of the present invention, and FIG. 2 is a partial sectional view of the cathode ray tube of FIG. 1.

As shown in FIGS. 1 and 2, the cathode ray tube has a tube-type outer appearance made of a glass material. The cathode ray tube includes a panel 22 provided with a fluorescent screen 20 inside thereof, a funnel 26 connected with the panel 22 and provided with a deflection unit 24 on the circumference thereof, and a neck portion 30 connected with the funnel 26 and provided with an electron gun 28 to scan a plurality of electron beams to the fluorescent screen 20.

As will be obvious from the drawings, the cathode ray tube is a flat panel type in which an outer surface of the panel 22 is flat. An inner surface (horizontal direction) of the panel 22 has a predetermined curvature. A color selection apparatus 32 adapted for such a cathode ray tube is mounted inside the panel 22 in the same manner as a typical shadow mask for a cathode ray tube, so as to select colors of the electron beams of R, G, and B scanned from the electron gun 28. This will be described in more detail with reference to FIG. 3.

Figure 3:
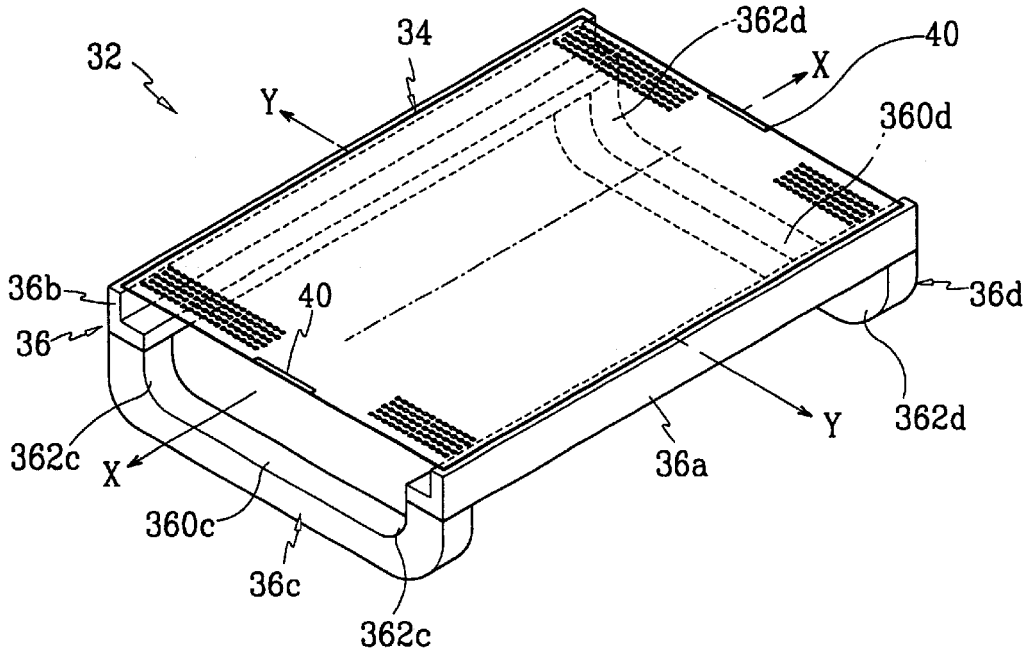
FIG. 3 is a perspective view illustrating a shadow mask used in the cathode ray tube shown in FIG. 1.

FIG. 3 is a perspective view illustrating the color selection apparatus 32 used in the cathode ray tube shown in FIG. 1. The color selection apparatus 32 includes a rectangular shaped mask 34 having a longitudinal axis (arrow X in the drawing) and a short axis (arrow Y in the drawing), and a frame 36 coupled with the mask 34 by tensing the mask 34 in the direction X or Y.

Figure 4:
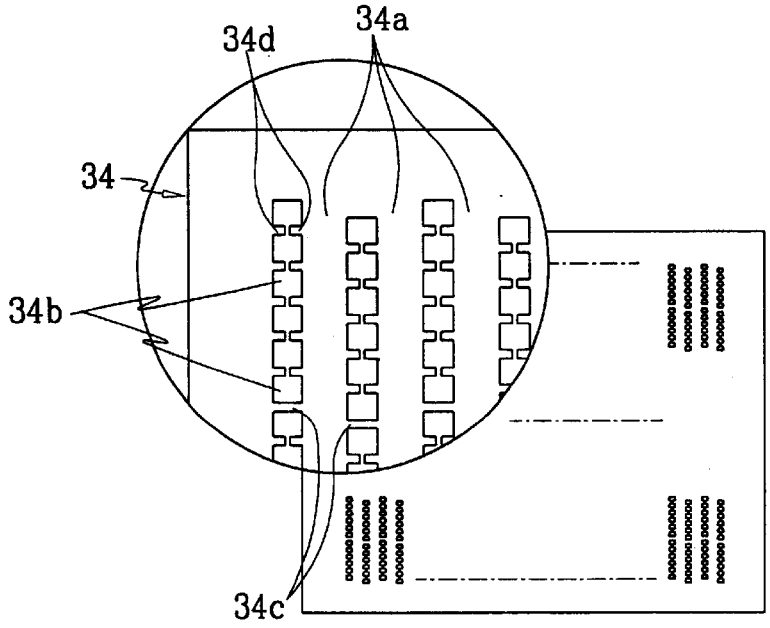
FIG. 4 is a partial plane view illustrating a mask included in a configuration of the shadow mask shown in FIG. 3.

In this embodiment, the mask 34 is provided with a flat thin plate of an iron (Fe) material and is coupled to the frame 36 in a state that it is tensed in the direction Y. At this time, as shown in FIG. 4, the mask 34 is formed in such a manner that a plurality of strips 34*a* that are spaced apart from one another at predetermined intervals are assembled with a plurality of electron beam through holes 34*b* formed between the strips 34*a* at predetermined vertical and horizontal pitches.

The strips 34*a* are arranged along the direction Y, and real bridges 34*c* are respectively arranged between the respective electron beams through holes 34*b* along the direction Y. That is to say, the electron beam through holes 34*b* are arranged on one line based on the direction Y in connection with the real bridges 34*c*. At this time, dummy bridges 34*d* are arranged within the electron beam through holes 34*b* in one direction of the election beam through holes 34*b*, for example, the direction X, and are extended from the strips 34*a* in an integral form.

In this embodiment, the dummy bridges 34*d* have an opposing symmetric structure within each electron beam through hole 34*b* in a plurality of pairs. It is preferable that the number of dummy bridges 34*d* is between a minimum of five to a maximum of 14 based on one row within each electron beam through hole 34*b*, considering actual thermal deformation of the mask 34 during action of the cathode ray tube.

The formation pattern and the number of dummy bridges 34*d* are not limited to the above examples. A dummy bridge area provided with the dummy bridges 34*d* can be selectively formed on the whole mask 34 or some portion of the mask 34 depending on the option conditions of the cathode ray tube. Thus, if the dummy bridge area provided with the dummy bridges 34*d* is formed on only some portion of the mask 34, then some electron beam through holes 34*b* may not have any dummy bridges 34*d*.

The frame 36 includes a pair of supporting members 36*a* and 36*b* and a pair of elastic members 36*c* and 36*d*. The supporting members 36*a* and 36*b* are arranged longitudinally along the direction X. The elastic members 36*c* and 36*d* include linear portions 360*c* and 360*d* arranged along the direction Y at a predetermined length, and nonlinear (bent) portions 362*c* and 362*d* arranged at both ends of the linear portions 360*c* and 360*d* in a vertical direction and contacting the supporting members 36*a* and 36*b*.

Figure 5:
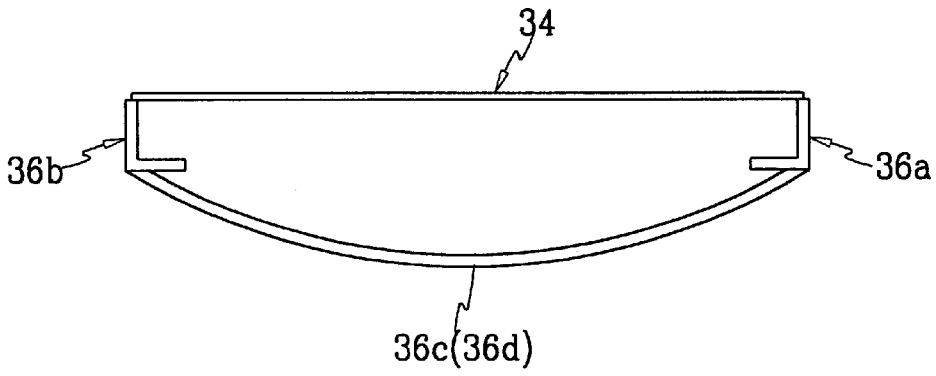
FIG. 5 is a side view illustrating the shadow mask according to an embodiment of the present invention.
Figure 6:
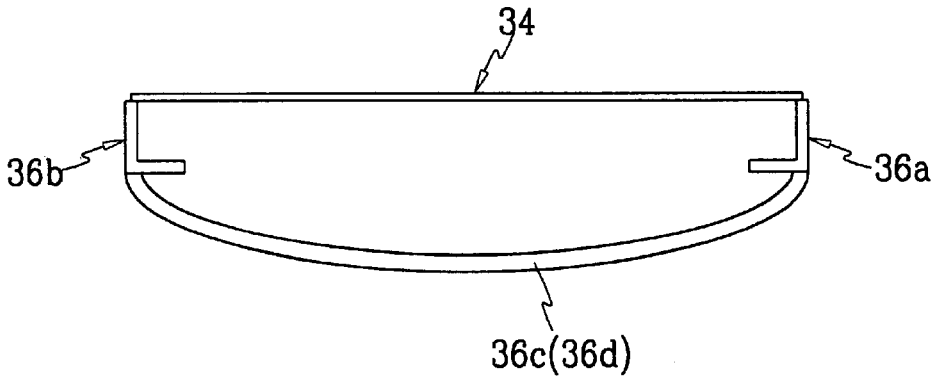
FIG. 6 is a side view illustrating a shadow mask according to another embodiment of the present invention.

The shapes of the elastic members 36*c* and 36*d* are not limited to the above example. In other words, as shown in FIGS. 5 and 6, the elastic members 36*c* and 36*d* may have an arch shape (FIG. 5) or an elliptical shape (FIG. 6) to wholly form a consecutive non-linear shape from one end to the other end.

The frame 36 constructed as above couples one end portion of each of the elastic members 36*c* and 36*d* to a respective end of the supporting member 36*a*, and the other end portion of each of the elastic members 36 c and 36 d to each respective end of the supporting member 36*b* by welding in a state such that the supporting members 36*a* and 36*b* are arranged in parallel with each other at a predetermined interval. The mask 34 tensed in the direction Y is coupled to upper end portions of the supporting members 36*a* and 36*b* so as to form one assembly.

Meanwhile, unlike the related art, the shadow mask of the present invention can effectively prevent howling of the mask 34 by the distribution of a tension applied to the strips 34*a* of the mask 34 even without forming damper wires that are arranged across the mask 34 in the direction X to prevent howling.

The distribution of the tension applied to the strips 34*a* of the mask 34 and its howling prevention degree of the mask will be described with reference to FIG. 7.

Figure 7A:
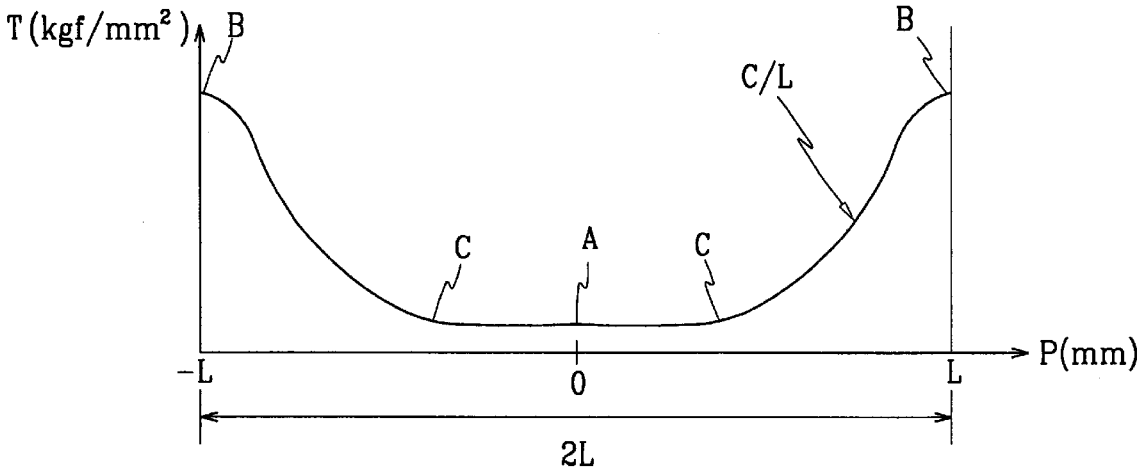
FIGS. 7A to 7B is a schematic view illustrating the distribution of a tension applied to the mask of the shadow mask according to FIGS. 3 through 6 of the present invention.
Figure 7B:
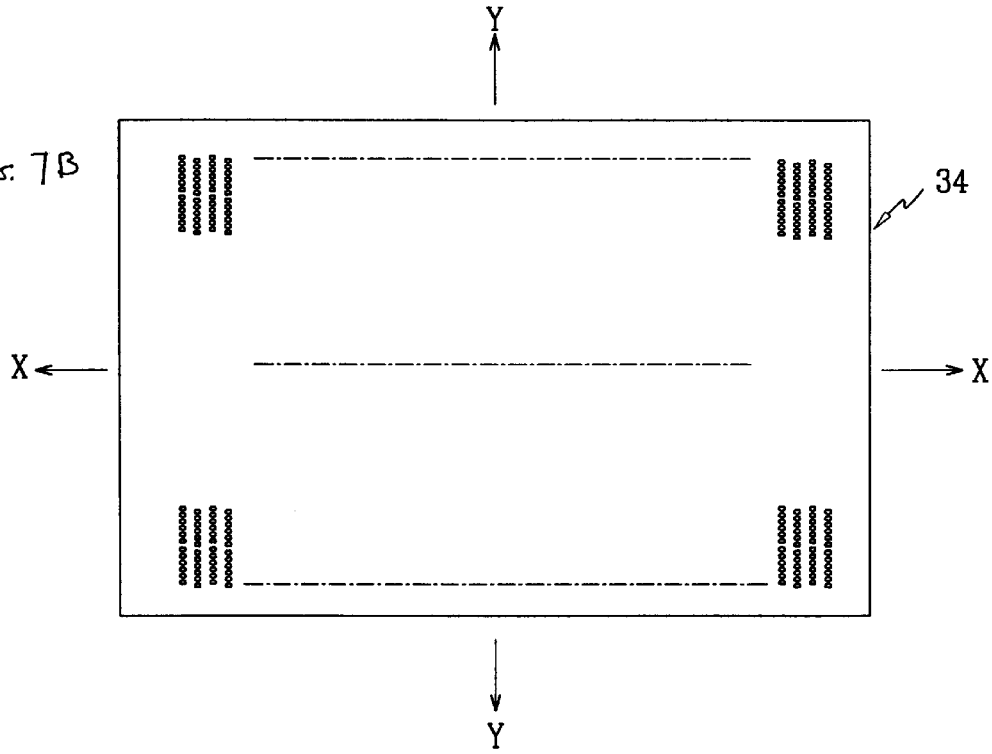

FIG. 7 is a schematic view illustrating the distribution of the tension applied to the strips 34*a* of the mask 34. In FIG. 7, a horizontal axis of a graph represents the position P of the mask 34 in the direction X and its vertical axis represents a tension T applied to each position of the strips 34*a* of the mask 34.

When viewing the mask 34 along the direction X, it is supposed that the center of the mask 34 is A, both side portions are B, and any one portion between the center A and both side portions B is C. In this case, the tension applied to the strips 34*a* of the mask 34 along the direction X forms a distribution curve C/L that satisfies the following equation.

$$|S_{A-C}|<|S_{C-B}|$$

In the above equation, $S_{A-C}$ represents a slope of a straight line that links a point A to a point C on the distribution curve of the tension, and $S_{C-B}$ represents a slope of a straight line that links the point C to a point B on the distribution curve of the tension.

In other words, the tension applied to the strips 34*a* of the mask 34 is configured such that an absolute value of the slope from the point A to the point C is smaller than an absolute value of the slope from the point C to the point B on the distribution curve C/L.

Such tension distribution is configured such that the amount of a tension substantially maintained to be flat is applied to a region C—C between both C and C as shown in the drawing, and after the point C, the tension is greater than at the point C and always increasing to the point B.

The point of C is preferably set between a point L/4 and a point L, supposing that the longitudinal length of the mask 34 corresponding to the direction X is 2L and the center A is 0 (L).

In more detail, when the mask is divided into two using the direction Y as an axis based on the point A, in a side that $S_{C-B}$ has a positive slope (right side on the drawing), the point C is set such that a tangent slope of the tension distribution curve at the point C is always greater than 0 and a tangent slope of the tension distribution in a portion between the point L/4 and the point C] is less than the tangent slope at the point C. Also, in a side that $S_{C-B}$ has a negative slope (left side on the drawing), the point C is set such that a tangent slope of the tension distribution curve at the point C is always smaller than 0 and a tangent slope of the tension distribution in a portion between the point L/4 and the point C] is greater (less negative) than the tangent slope at the point C.

Figure 8A:
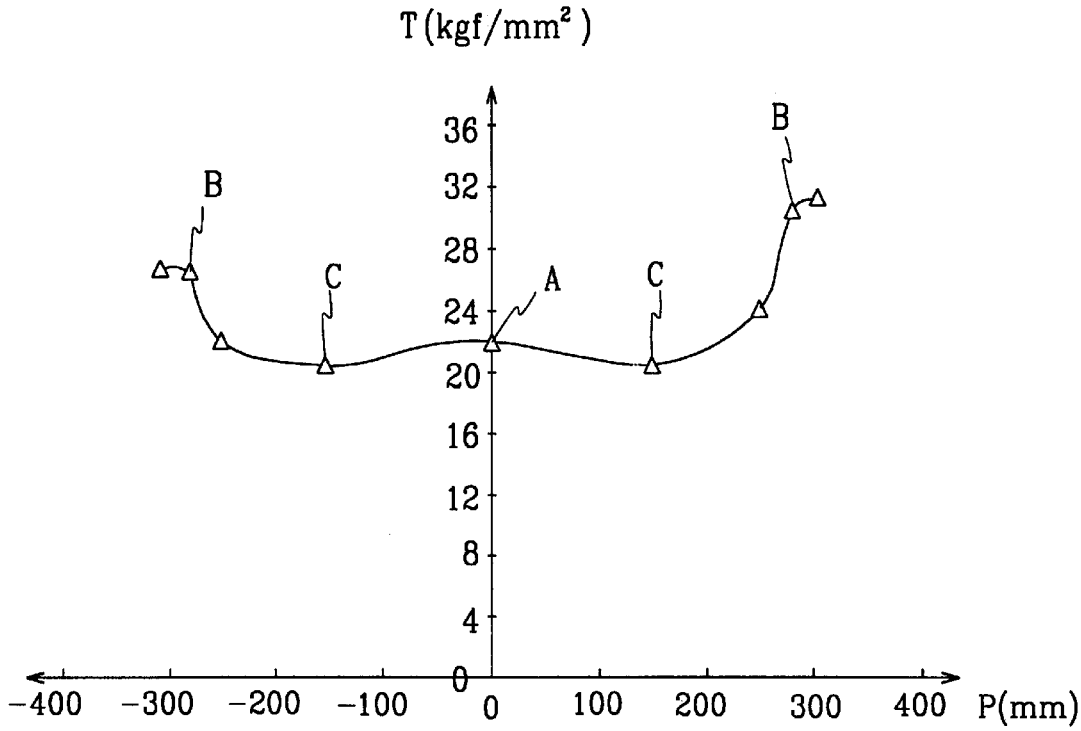
FIGS. 8A to 10B are graphs illustrating the distribution of a tension applied to the mask and its resultant amplitude according to the present invention.

FIG. 8A is a graph illustrating the distribution of the tension applied to the mask of the shadow mask according to the present invention. As shown in FIG. 8A, the tension value in the region C—C set around the center A of the mask and both side portions B is almost flat and the tension value in the region C—C is within the range of 22 kgf/mm$^2$ while the tension value between regions C-B and C-B is greater than the above tension value in the region C—C.

Figure 8B:
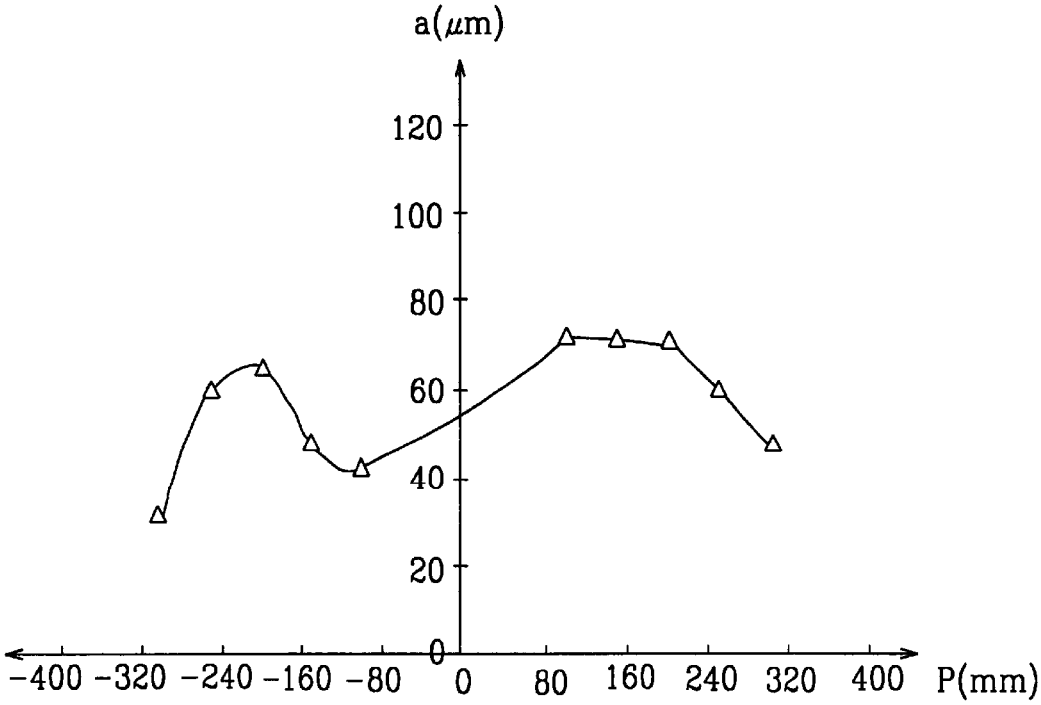
Figure 9A:
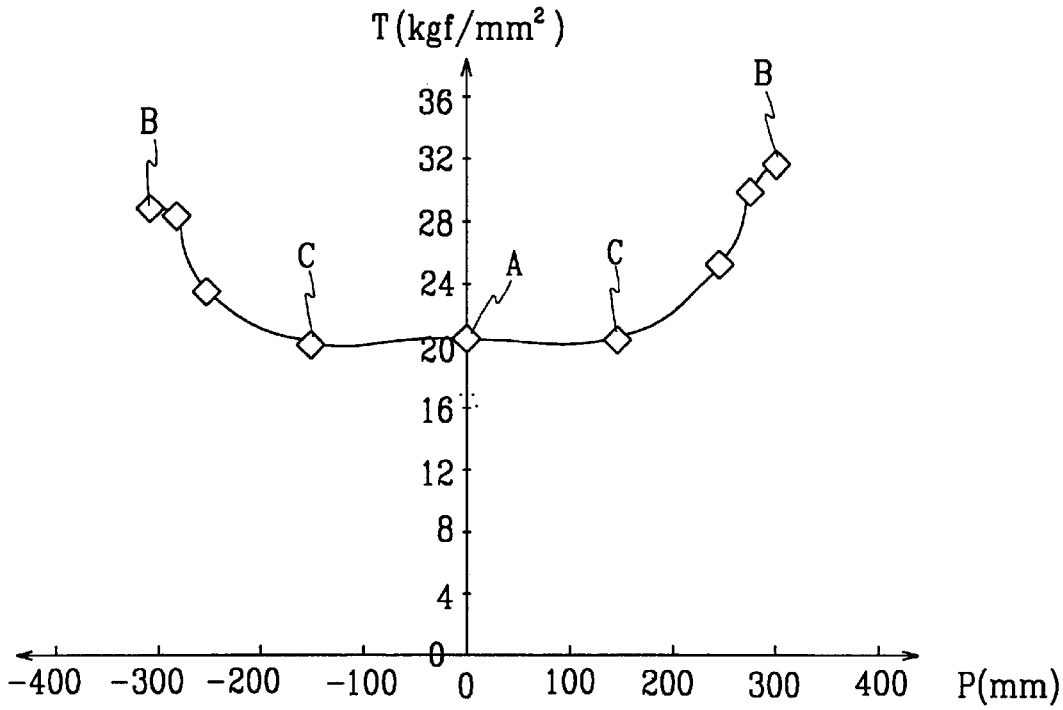
Figure 9B:
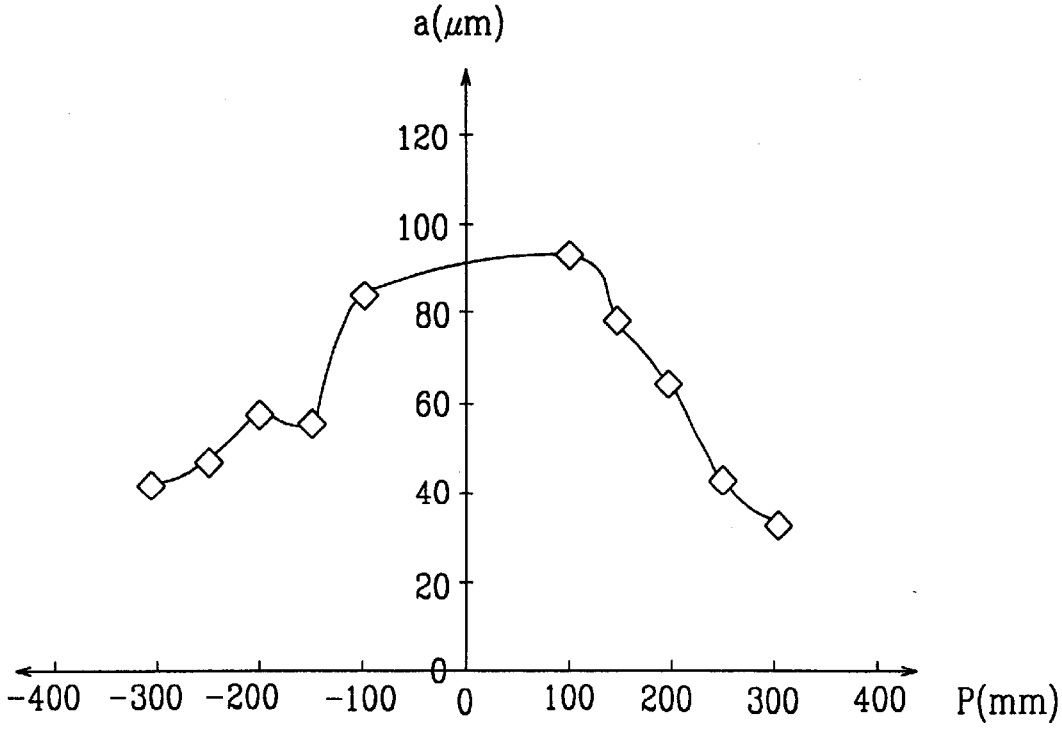
Figure 10A:
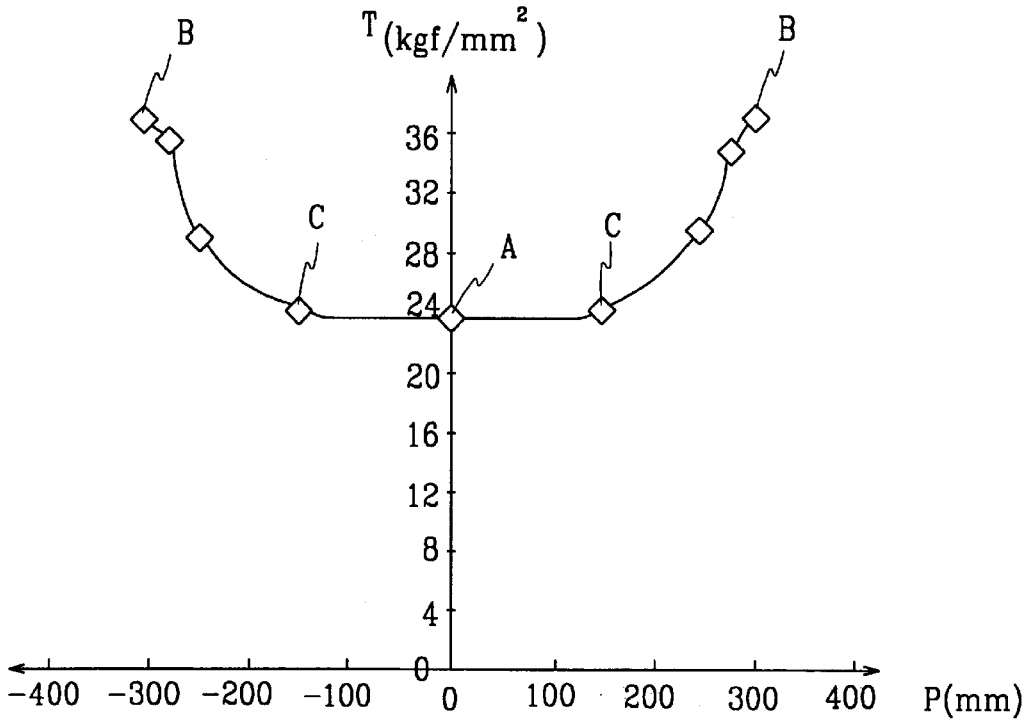
Figure 10B:
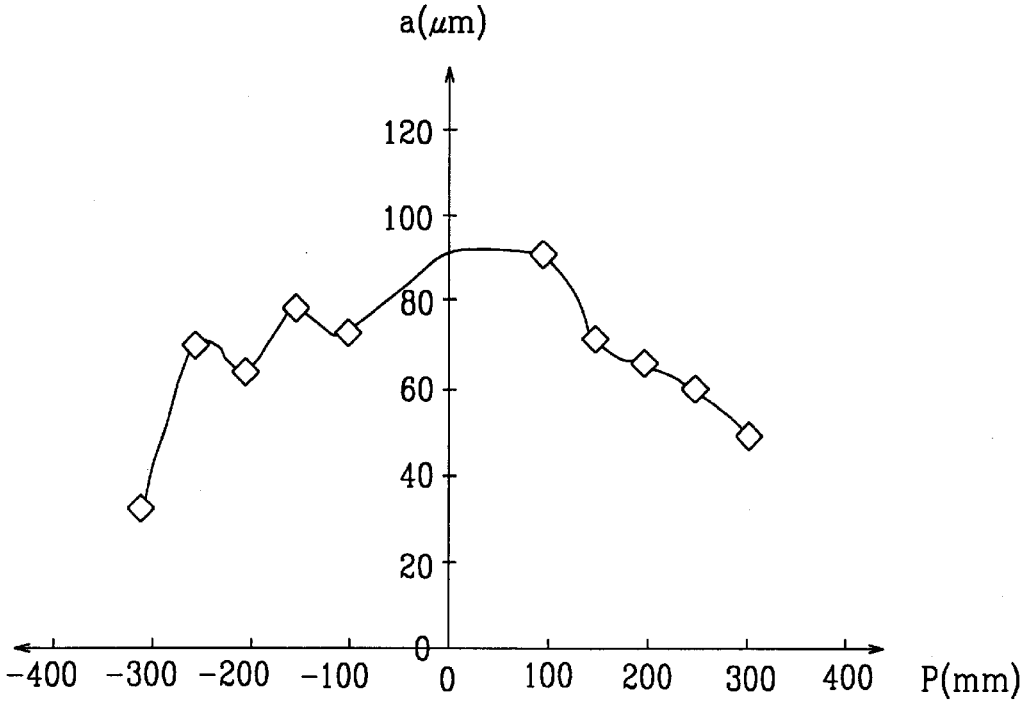

When the mask has the above tension distribution, the value of amplitude (a) resulting from howling on the strips of the mask is shown in a graph of FIG. 8 B. The value of amplitude (a) on the strips of the whole mask is in the range of minimum 35 $\mu$m to maximum 70 $\mu$m. It is noted that this range of difference in the amplitude (a) is slight.

The value of the amplitude (a) of the mask 34 is obtained by measuring the amplitude generated when hitting the panel of the cathode ray tube provided with the shadow mask after moving a circular weight of about 400 g from a predetermined height of about 59 cm to the center of the panel under a vacuum state.

FIGS. 9A to 10B are graphs illustrating the distribution of the tension applied to a mask and its resultant amplitude according to another performance of testing the tension versus the degree of amplitude (a) of the present invention. It is noted that the same results as above are obtained in this embodiment of the present invention.

Figure 11A:
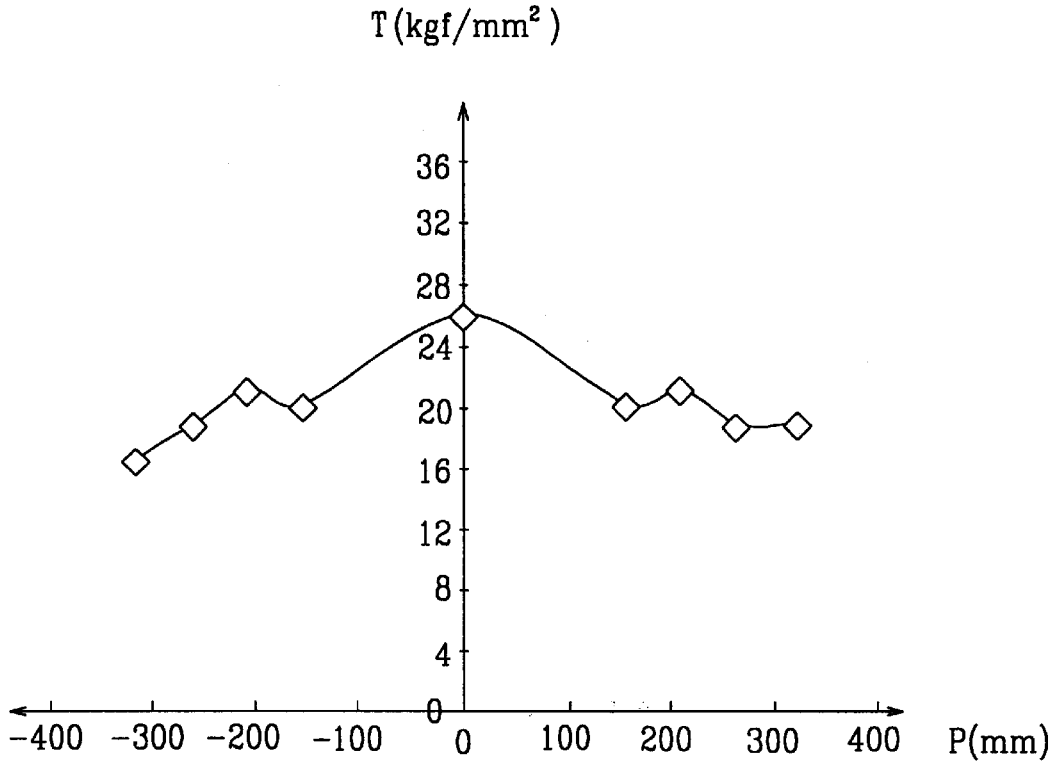
FIGS. 11A and 11B are graphs illustrating the distribution of a tension applied to the mask and its resultant amplitude according to a comparison example of the present invention.
Figure 11B:
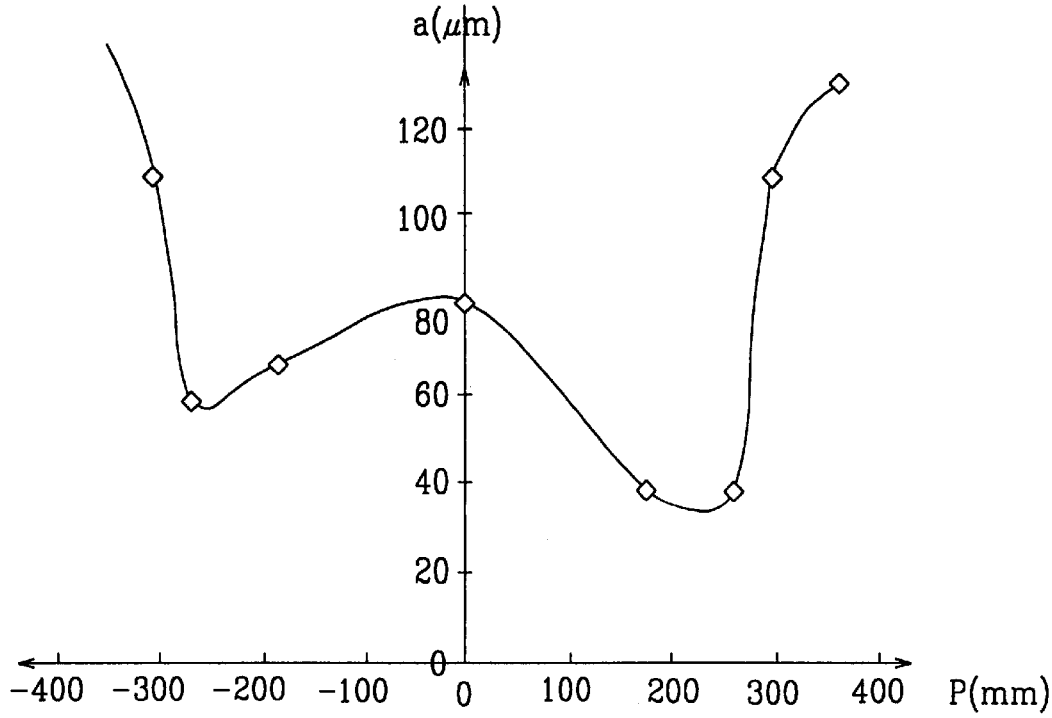

FIGS. 11A and 11B are graphs illustrating a comparison example of the present invention. FIG. 11A illustrates the distribution of A shaped tension in which a predetermined tension is applied to the center on a mask having the same conditions (material and hole pattern) as those of the above embodiments and the value of the tension applied toward both peripheries becomes smaller than the tension applied to the center. FIG. 11B illustrates the value of amplitude generated when the mask has the distribution of A shaped tension as above. In FIG. 11B, it is noted that howling characteristics causes performance to deteriorate by increasing the amplitude at both peripheries of the mask.

As described above, in the present invention, a problem related to howling of the tension mask for a cathode ray tube has been solved by the distribution of the tension applied to the strips 34*a* of the mask 34. Finally, upon comparing the present invention with other comparison examples, the mask (#1 of FIGS. 12A and 12B) of the present invention has more stable howling characteristics by reducing the amplitude at the peripheries than a mask (#2 of FIGS. 12A and 12B) having the distribution of the tension similarly applied to the whole mask and a mask (#3 of FIGS. 12*a* and 12*b*) having the distribution of the A shaped tension.

Figure 12A:
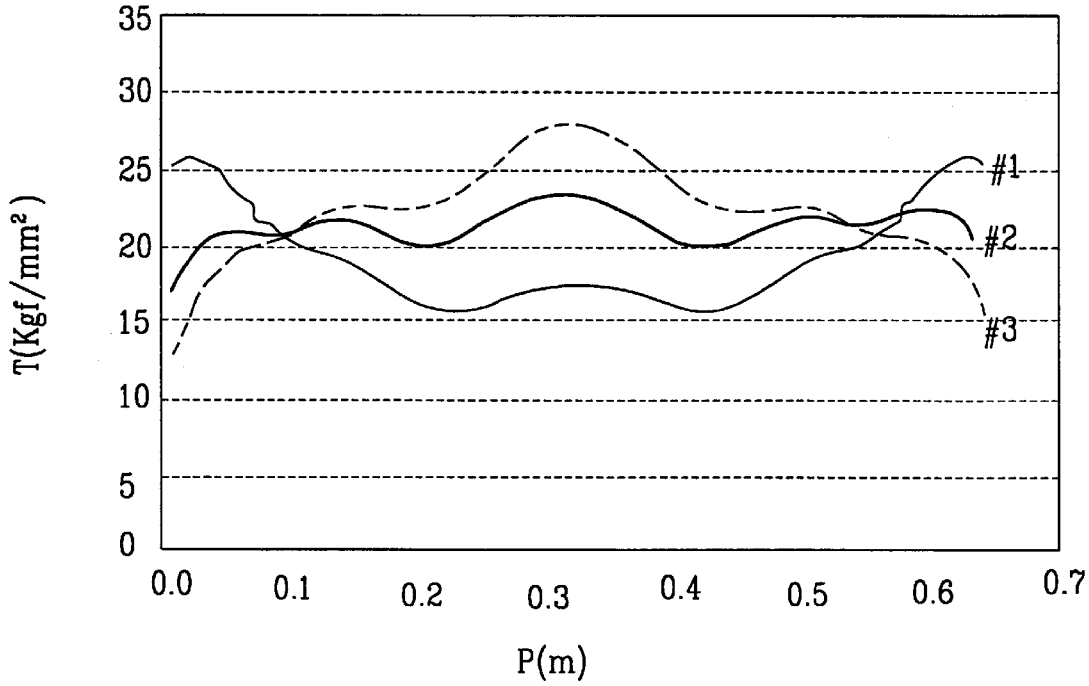
FIGS. 12A and 12B are graphs illustrating the distribution of a tension applied to the mask according the present invention, the distribution of a tension applied to the mask according to the comparison example, and their resultant amplitudes.
Figure 12B:
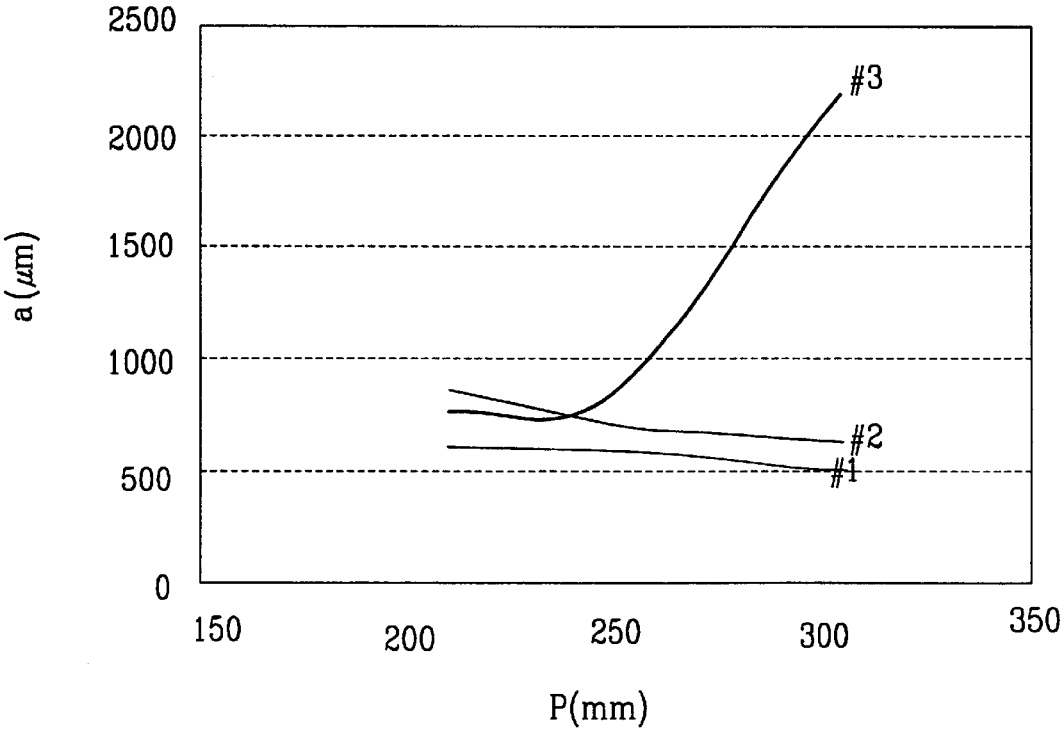

For reference, FIGS. 12A and 12B illustrate the tension distribution and amplitude characteristics theoretically analyzed in each case. FIG. 12A illustrates the tension distribution based on one side (left side) of the mask and FIG. 12B illustrates the amplitude characteristics based on the one side of the mask.

Meanwhile, for the tension distribution of the present invention, it is preferable that the tension T applied to the strips 34*a* of the mask 34 satisfies the following equation.

$$T_{C\text{-}B/max} \geqq 1.3 T_{C\text{—}C/av}$$

In this equation, $T_{C\text{—}C/av}$(kgf/mm$^2$) represents an average tension in the region C—C, and $T_{C\text{-}B/max}$(kgf/mm$^2$) represents a maximum tension in the region C-B.

In other words, it is preferable that the maximum tension in the region C-B on the mask 34 is equal to or greater than 1.3 times the average tension in the region C—C. This is because that if the maximum tension has a value smaller than 1.3 times the average tension, the tension applied to the peripheries of the mask 34 is too low so the amplitude of howling generated at the peripheries becomes greater, thereby enhancing the howling characteristics. In the above relationship, it is preferable that the maximum tension $T_{C\text{-}B/max}$ is at least 20 kgf/mm$^2$ or greater.

Furthermore, in the present invention, supposing that the average tension in the region C—C is $T_{C\text{—}C/av}$(kgf/mm$^2$), the minimum tension is $T_{C\text{—}C/min}$(kgf/mm$^2$), and the maximum tension is $T_{C\text{—}C/max}$(kgf/mm$^2$), the tension set in the region C—C satisfies the following equation.

$$|T_{C\text{—}C/max} - T_{C\text{—}C/min}| / T_{C\text{—}C/av} < 0.2$$

That is, as described above, the tension is set in the region C—C at an almost constant (flat) value. However, the tension distribution curve having at least one of the maximum value or the minimum value is substantially formed, as shown in FIG. 8 A. In this case, it is preferable that the tension applied in the region C—C is set to satisfy the above equation so as to minimize howling characteristics of the mask.

Figure 13:
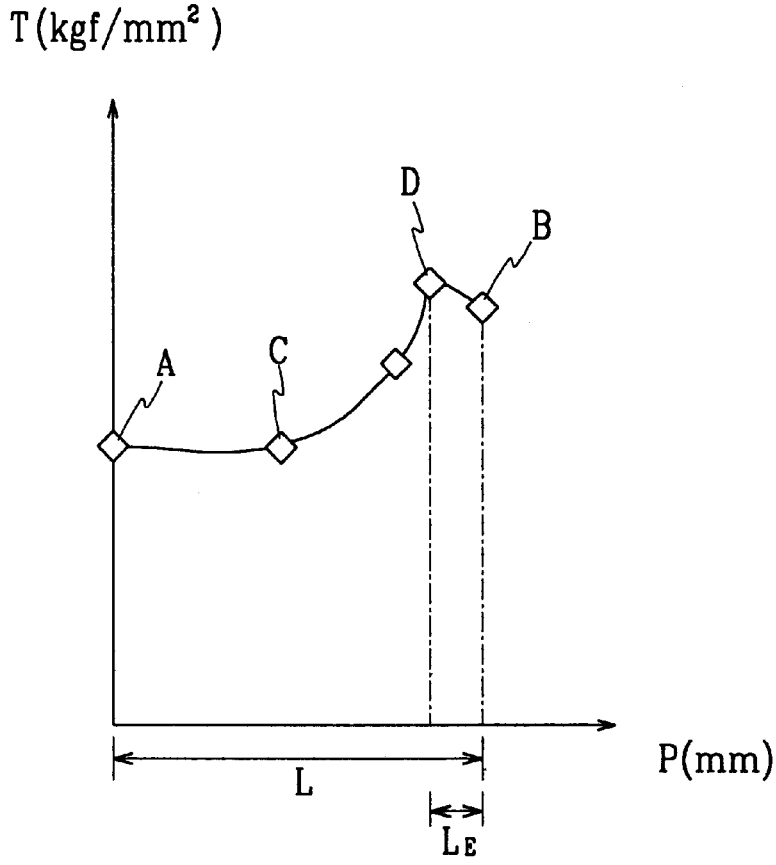
FIG. 13 is a graph illustrating the distribution of a tension applied to a mask according to another embodiment of the present invention.

Moreover, the tension distribution of the present invention, as shown in FIG. 13, may be configured such that the tension value is rapidly increasing at the point C toward both end portions B from the center of the mask 34 while it is slowing or decreasing in the vicinity of both end portions B. In other words, when the points A, B, and C of the mask 34 are set and any one portion between the points B and C is set as D, the tension distribution curve satisfies the following equation.

$$|S_{C\text{-}D}| > |S_{D\text{-}B}|$$

In the above equation, $S_{C\text{-}D}$ represents a slope of a straight line that links the point C to the point D on the tension distribution curve, and $S_{D\text{-}B}$ represents a slope of a straight line that links the point D to the point B on the tension distribution curve.

If at least one howling attenuation member 40 is mounted at each end of a short side of the mask 34, the aforementioned tension distribution curve, as shown in FIG. 3, maintains favorable howling attenuation time and obtains an advanced effect of the howling attenuation member 40. Also, the distance LE between the points D and B satisfies the relation of $L_E < 0.3L$, supposing that the distance between the points A and B is L.

Meanwhile, the tension distribution of the mask in the shadow mask according to the present invention illustrates the value of the tension applied to the mask after a blackening process in a process for manufacturing the shadow mask. Moreover, the cathode ray tube that can be provided with the shadow mask of the present invention has a large sized screen such as 29 in., 32 in., and 34 in., and a screen ratio is in the range of 4:3 or 16:9.

As aforementioned, the shadow mask for a cathode ray tube according to the present invention has the following advantages.

Howling characteristics of the mask, especially howling characteristics at the peripheries of the mask can be improved depending on the substantial distribution value of the tension applied to the strips of the mask. Accordingly, if the shadow mask is applied to a flat panel cathode ray tube with a large sized screen, the cathode ray tube having an improved quality grade can be obtained.

Furthermore, since the mask is made of Fe material, the manufacturing cost can be reduced as compared with the related art mask made of Invar material. Moreover, since no damper wires are arranged across the mask to attenuate howling, a visual problem that may occur on the screen in the cathode ray tube can be solved.

While the present invention has been described and illustrated herein with reference to the preferred embodiments thereof, it will be apparent to those skilled in the art that various modifications and variations can be made therein without departing from the spirit and scope of the invention. Thus, it is intended that the present invention covers the modifications and variations of this invention that come within the scope of the appended claims and their equivalents.

What is claimed is:

1. A color selection apparatus for a cathode ray tube comprising:

an iron mask having a longitudinal axis and a short axis; and a frame coupled with the mask and tensing the mask in one direction of the longitudinal and short axes;

the mask comprising a plurality of strips spaced apart from one another at predetermined intervals, and a plurality of electron beam through holes formed by a plurality of real bridges arranged between the respective strips at predetermined pitches;

wherein a center point of the mask along the longitudinal axis is A, both end points of the mask along the longitudinal axis are B, a length of a longitudinal side of the mask is 2L, points greater than L/4 from the point A in each direction are C, a tension applied to the strip of the point A is smaller than a tension applied to the strips of the points B, and a distribution curve of a tension applied to the strips of the mask along the longitudinal direction satisfies the following equation;

$$|S_{A\text{-}C}|<S_{C\text{-}B}|$$

wherein $S_{A\text{-}C}$ represents a slope of a straight line that links the point A to one of the points C on the tension distribution curve and $S_{C\text{-}B}$ represents a slope of a straight line that links the one point C to the corresponding point B on the tension distribution curve.

2. The color selection apparatus for a cathode ray tube of claim 1, wherein when the mask is divided into two using the short direction as an axis based on the point A, one of the points C in a side that $S_{C\text{-}B}$ has a positive slope such that a tangent slope of the tension distribution curve at the point C is always positive.

3. The color selection apparatus for a cathode ray tube of claim 2, wherein when the mask is divided into two using the short direction as an axis based on the A, the other point C in the other side that $S_{C\text{-}B}$ has a negative slope such that a tangent slope of the tension distribution curve at the other point C is always negative.

4. The color selection apparatus for a cathode ray tube of claim 2, wherein the tension applied to the strips is continuously increasing as a distance beyond the points C from the point A increases.

5. The color selection apparatus for a cathode ray tube of claim 2 wherein the maximum tension is at least 20 kgf/mm$^2$.

6. The color selection apparatus for a cathode ray tube of claim 1, wherein an average tension in a region C—C between the points C set on the tension distribution curve is $T_{C—C/av}$(kgf/mm$^2$) and a maximum tension in each of regions C-B is $T_{C\text{-}B/max}$(kgf/mm$^2$), wherein $T_{C—C/av}$ and $T_{C\text{-}B/max}$ satisfy the following equation:

$$T_{C\text{-}B/max} \geqq 1.3T_{C—C/av}.$$

7. The color selection apparatus for a cathode ray tube of claim 6, wherein the maximum tension is at least 20 kgf/mm$^2$.

8. The color selection apparatus for a cathode ray tube of claim 1, wherein an average tension in a region C—C between the points C is $T_{C—C/av}$(kgf/mm$^2$), a minimum tension in the region C—C is $T_{C—Cmin}$(kgf/mm$^2$), and a maximum tension in the region C—C is $T_{C—C/max}$(kgf/mm$^2$), wherein $T_{C—C/av}$, $T_{C—C/min}$, and $T_{C—C/max}$ satisfy the following equation.

$$|T_{C—C/max}-T_{C—C/min}|/T_{C—C/av}<0.2$$

9. The color selection apparatus for a cathode ray tube of claim 1, wherein corresponding points between the points B and the points C, respectively, are D, wherein the tension distribution curve satisfies the following equation;

$$|S_{C\text{-}D}|>|S_{D\text{-}B}|$$

wherein $S_{C\text{-}D}$ represents a slope of a straight line that links the one point C to the corresponding point D on the tension distribution curve and $S_{D\text{-}B}$ represents a slope of a straight line that links the corresponding point D to the corresponding point B on the tension distribution curve.

10. The color selection apparatus for a cathode ray tube of claim 9, wherein a distance between the corresponding points B and D based on the longitudinal axis is $L_E$, and the distance $L_E$ satisfies the following equation;

$$L_E<0.3L.$$

11. The color selection apparatus for a cathode ray tube of claim 1, wherein the mask includes a dummy bridge area provided with dummy bridges, the dummy bridges being extended from the strips in at least one direction of each electron beam through hole within the dummy bridge area and being arranged within each electron beam through hole within the dummy bridge area.

12. The color selection apparatus for a cathode ray tube of claim 1, wherein the electron beam through holes are formed in a slot type longitudinally arranged in the short direction.

13. The color selection apparatus for a cathode ray tube of claim 1, further comprising howling attenuation members mounted at each end of a short side of the mask to attenuate howling of the mask.

14. The color selection apparatus for a cathode ray tube of claim 1, wherein the frame comprises:

a pair of supporting members spaced apart from each other at a predetermined interval; and a pair of elastic members arranged between the supporting members and coupled to the supporting members to maintain the tension applied to the mask.

15. The color selection apparatus for a cathode ray tube of claim 14, wherein each of the elastic members comprises a linear portion and a pair of non-linear portions at respective opposite ends of the linear portion.

16. The color selection apparatus for a cathode ray tube of claim 14, wherein each of the elastic members comprises a non-linear portions from one end to the other end thereof.

17. The color selection apparatus for a cathode ray tube of claim 16, wherein each of the elastic members has an arc shape.

18. The color selection apparatus for a cathode ray tube of claim 16, wherein each of the elastic members as an elliptical shape.

19. A cathode ray tube comprising:

a panel provided with a fluorescent screen inside thereof;

a funnel connected with the panel and provided with a deflection unit on a circumference thereof, the deflection unit deflecting electron beams;

a neck portion connected with the funnel and provided with an electron gun to scan the electron beams to the fluorescent screen; and a color selection apparatus fixed inside the panel, selecting the electron beams to land on corresponding phosphors of the fluorescent screen, the color selection apparatus comprising an iron mask having a longitudinal axis and a short axis; and a frame coupled with the mask and tensing the mask in one direction of the longitudinal and short axes, the mask comprising a plurality of strips spaced apart from one another at predetermined intervals;

a plurality of electron beam through holes formed by a plurality of real bridges arranged between the respective strips at predetermined pitches, and at least one dummy bridge extended from the strips in one direction of the electron beam through holes and arranged within the electron beam through holes, wherein a center point of the mask along the longitudinal axis is A, both end points of the mask along the longitudinal axis are B, a length of a longitudinal side of the mask is wherein a center point of the mask along the longitudinal axis is A, both end points of the mask along the longitudinal axis are B, a length of a longitudinal side of the mask is 2L, points greater than L/4 from the point A in each direction are C, a tension applied to the strip of the point A is smaller than a tension applied to the strips of the point B and a distribution curve of a tension applied to the strips of the mask along the longitudinal direction satisfies the following equation;

$$|S_{A-C}|<|S_{C-B}|$$

wherein $S_{A-C}$ represents a slope of a straight line that links the point A to one of the points C on the tension distribution curve and $S_{C-B}$ represents a slope of a straight line that links the point C to the corresponding point B on the tension distribution curve.

20. The cathode ray tube of claim 19, wherein the panel has an outer surface and an inner surface, the outer surface being substantially flat and the inner surface being curved.

* * * * *